US005893560A

United States Patent [19]

McClelland

[11] Patent Number: 5,893,560

[45] Date of Patent: Apr. 13, 1999

[54] GAMES, PUZZLES AND THE LIKE

[76] Inventor: Patrick McClelland, 8 Rockcliffe, Blackrock, Co., Cork, Ireland

[21] Appl. No.: 08/809,638

[22] PCT Filed: Sep. 25, 1995

[86] PCT No.: PCT/IE95/00049

§ 371 Date: Mar. 26, 1997

§ 102(e) Date: Mar. 26, 1997

[87] PCT Pub. No.: WO96/09865

PCT Pub. Date: Apr. 4, 1996

[30] Foreign Application Priority Data

Sep. 26, 1994 [IE] Ireland ..... S940765

[51] Int. Cl.[6] ..... A63F 9/10

[52] U.S. Cl. ..... 273/157 R

[58] Field of Search ..... 273/153 R, 157 R, 273/156, 445, 153 S

[56] References Cited

U.S. PATENT DOCUMENTS

| | | | |
|---|---|---|---|
| 3,909,003 | 9/1975 | Rabinovich | 273/157 R |
| 4,219,194 | 8/1980 | Powers | 273/157 R |
| 4,474,371 | 10/1984 | Silbermintz | 273/153 S |
| 4,756,533 | 7/1988 | Hopkins et al. | 273/157 R |
| 4,838,551 | 6/1989 | Volpert | 273/157 R |
| 4,948,146 | 8/1990 | Snyder et al. | 273/157 R |
| 5,108,291 | 4/1992 | Kuo | 273/157 R |
| 5,351,957 | 10/1994 | Scott | 273/157 R |

*Primary Examiner*—Steven Wong

*Attorney, Agent, or Firm*—Hardaway Law Firm, P.A.

[57] ABSTRACT

A game including a game board is provided with two recesses and including two sets of pieces which may be assembled to reconstitute two similar pictures, one picture within and filling each recess, the pieces of the two sets being of the same shape and size but each piece belonging to one set only and not the other by virtue of the pieces bearing non-interchangeable elements of pictures to be reconstituted. The puzzle may be played competitively, with two players racing against one another to complete pictures.

13 Claims, 4 Drawing Sheets

GAMES, PUZZLES AND THE LIKE

FIELD OF THE INVENTION

The present invention relates to games, puzzles and the like involving reconstitution of pictures, images or designs, hereinafter referred to simply as "pictures".

PRIOR ART

A traditional jigsaw puzzle comprises a picture cut into interlocking jigsaw pieces. In use the pieces are jumbled, and the puzzle is to assemble the pieces to reconstitute the picture. The jigsaw puzzle may be used by one person, or by several persons.

Children's toys are known comprising a number of cube shaped blocks with each block bearing elements of a picture on several faces thereof. The blocks are assembled to form a bigger block bearing a picture on each exposed face thereof.

A variety of other games and puzzles are also known.

OBJECT AND SUMMARY OF THE PRESENT INVENTION

The invention provides a game including a game board provided with two recesses and including two sets of pieces which may be assembled to reconstitute two similar pictures, one picture within and filling each recess, the pieces of the two sets being of the same shape and size but each piece belonging to one set only and not the other by virtue of the pieces bearing non-interchangeable elements of pictures to be reconstituted.

The puzzle may be played competitively, with two players racing against one another to complete pictures.

Preferably the pieces are rectangular, with one picture being reconstituted from pieces bearing upright rectangular elements of the picture and the other picture being reconstituted from pieces bearing horizontal rectangular elements of the picture.

Preferably the game includes additional pieces.

Preferably the two pictures are identical.

BRIEF DESCRIPTION OF THE DRAWINGS

The invention will now be described with reference to the accompanying drawings which show, by way of example only, two embodiments of the game according to the invention, and the manner in which it is played. In the drawings.

DETAILED DESCRIPTION OF PREFERRED EMBODIMENT

Figure 1:
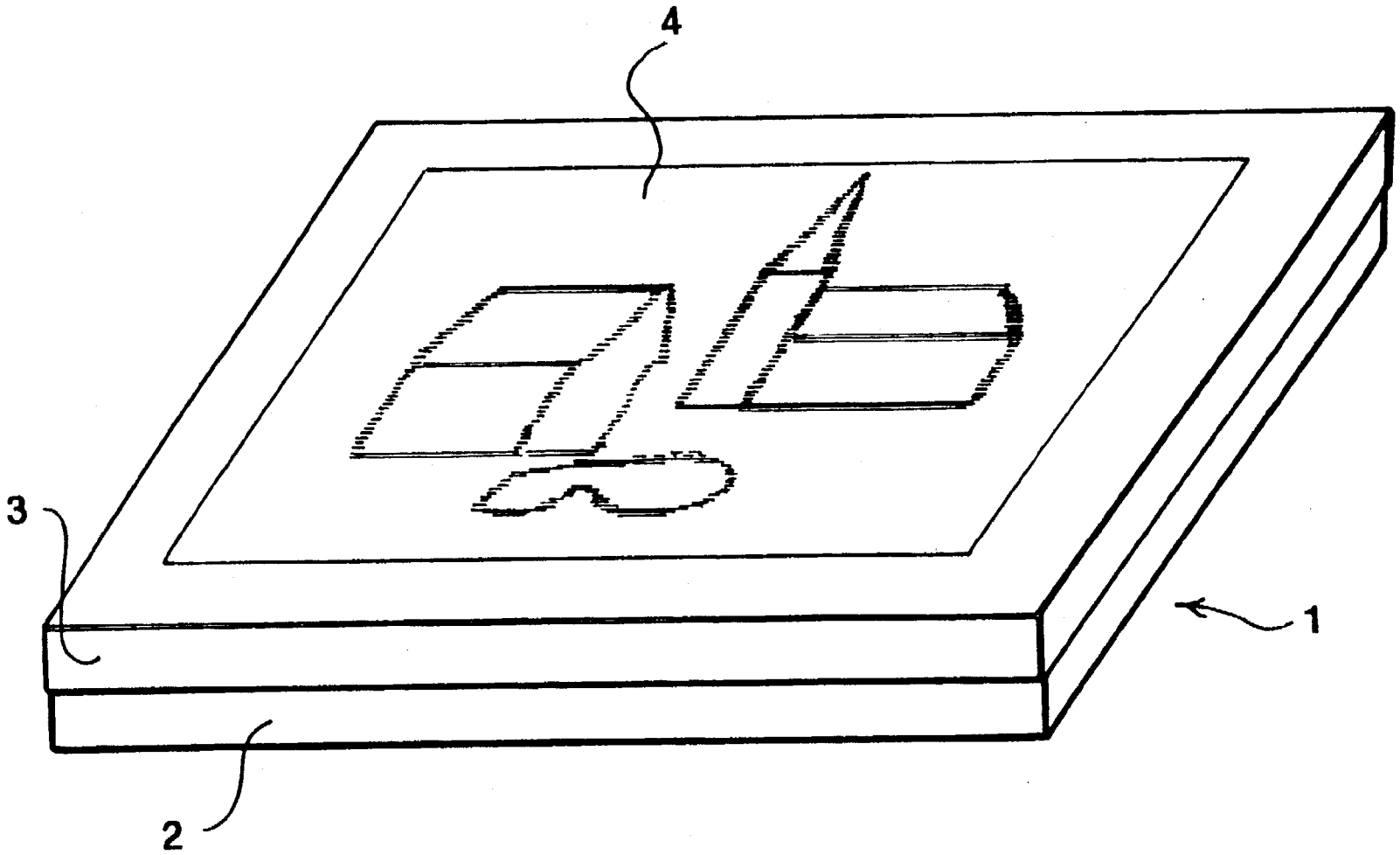
FIG. 1 is a perspective view of a box containing a game in accordance with the first embodiment.

FIG. 1 shows the box generally designated 1, comprising a box tray 2 and a box cover 3 bearing a picture 4.

Figure 2:
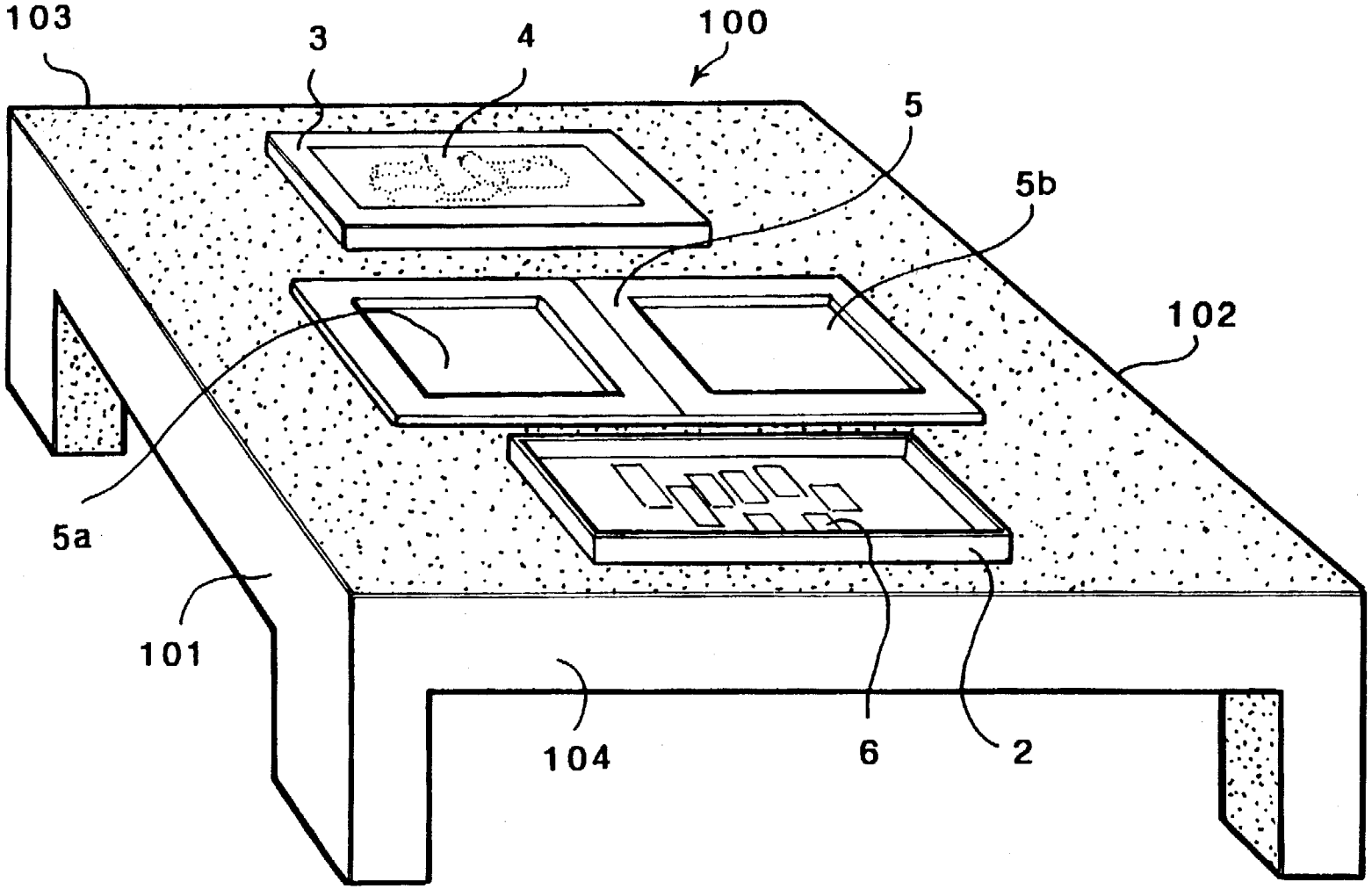
FIG. 2 is a perspective view showing the game of FIG. 1 in use.

FIG. 2 shows the various parts of the game and the use thereof. The Figure shows a table 100 which forms no part of the present invention. Two players (not shown) sit at opposite sides 101, 102 of the table. The cover 3 of the box is removed and is placed face upwards to one side 103 of the table. The tray 2 of the box is placed at the other side 104 of the table. A board 5 is removed from the tray and is placed centrally on the table 100. The board comprises two recesses 5*a*, 5*b*, one facing each player. The tray 2 contains pieces 6 for use in reconstituting two identical pictures.

Figure 3A:
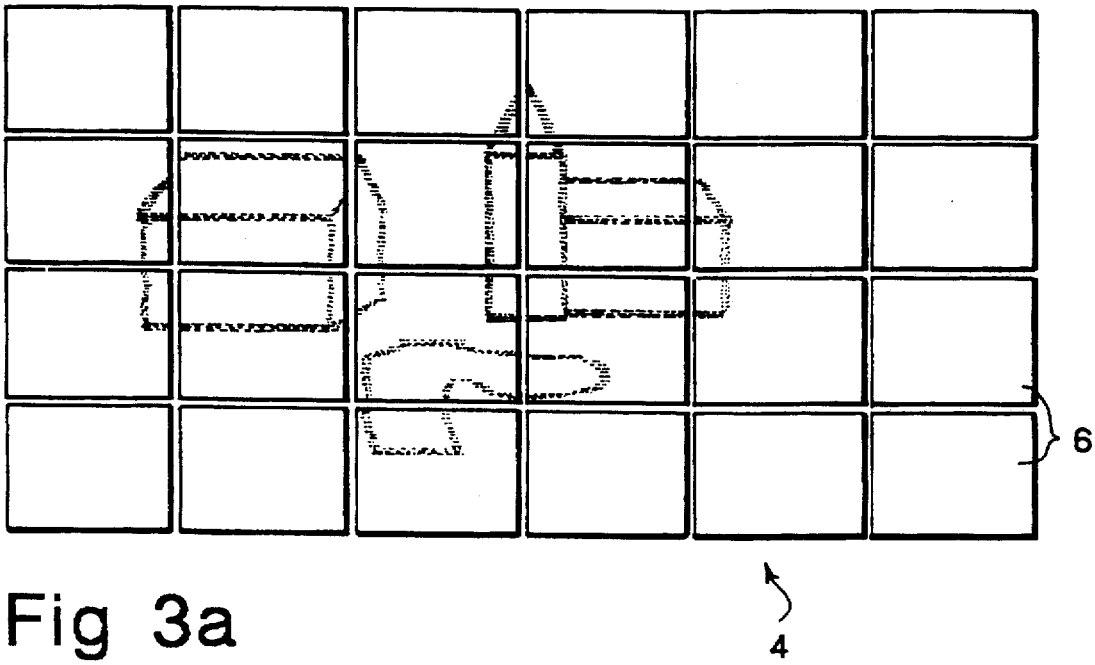
FIGS. 3*a* and 3*b* show two reconstituted pictures of the first embodiment.
Figure 3B:
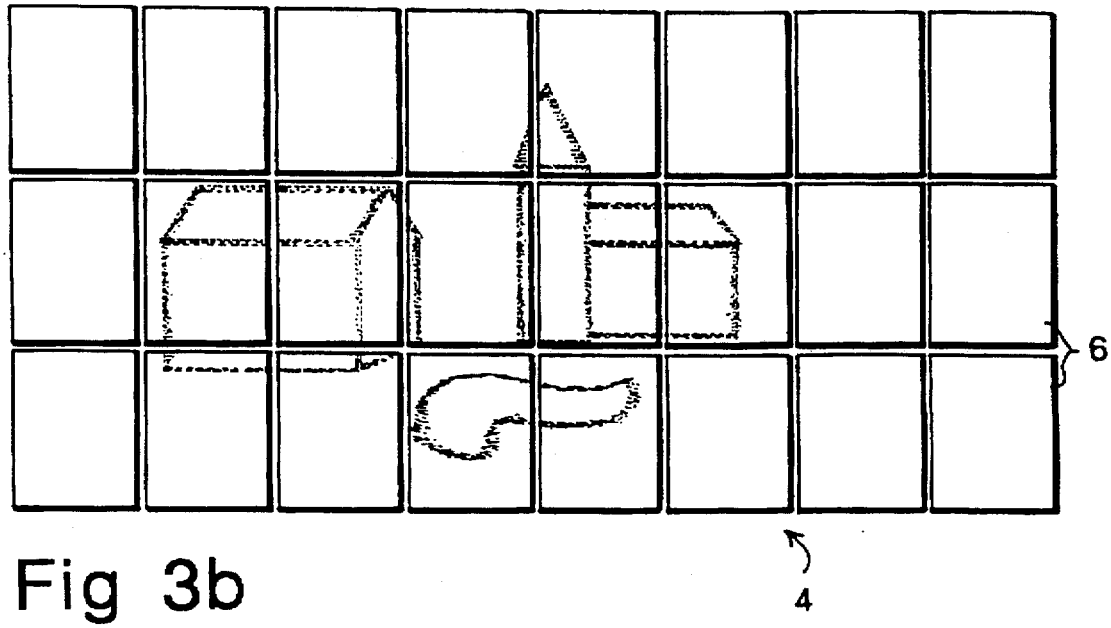

The pieces 6 comprise two sets. The two pictures 4 can be assembled, one by each player, in competition with one another. Although the two pictures 4 to be reconstituted are identical, and although all the pieces are of identical shape and size, nevertheless each piece 6 belongs to a particular set. Referring to FIGS. 3*a* and 3*b*, the two sets of pieces 6 are shown assembled to form two identical pictures 4. The pieces 6 are rectangular. As shown in FIGS. 3*a* and 3*b*, the two identical pictures 4 have been die cut, and the die cutting of the picture 4 shown in FIG. 3*b* is at right angles relative to the die cutting of the picture 4 shown in FIG. 3*a*, so that the picture shown in FIG. 3*a* is divided into upright rectangular pieces whereas the picture shown in FIG. 3*b* is divided into horizontal rectangular pieces.

The object of the game is to reconstitute a picture 4. The player seated at side 101 uses recess 5*a* of the board, the player seated at side 102 uses recess 5*b* of the board. Each player should try and complete his picture 4 as quickly as possible, but a player may not hoard pieces 6, a player may not stack pieces 6 on top of another piece 6, a player may possess at any one time only as many pieces 6 as will fit in one layer within the confines of a recess 5*a* or 5*b*.

Figure 4A:
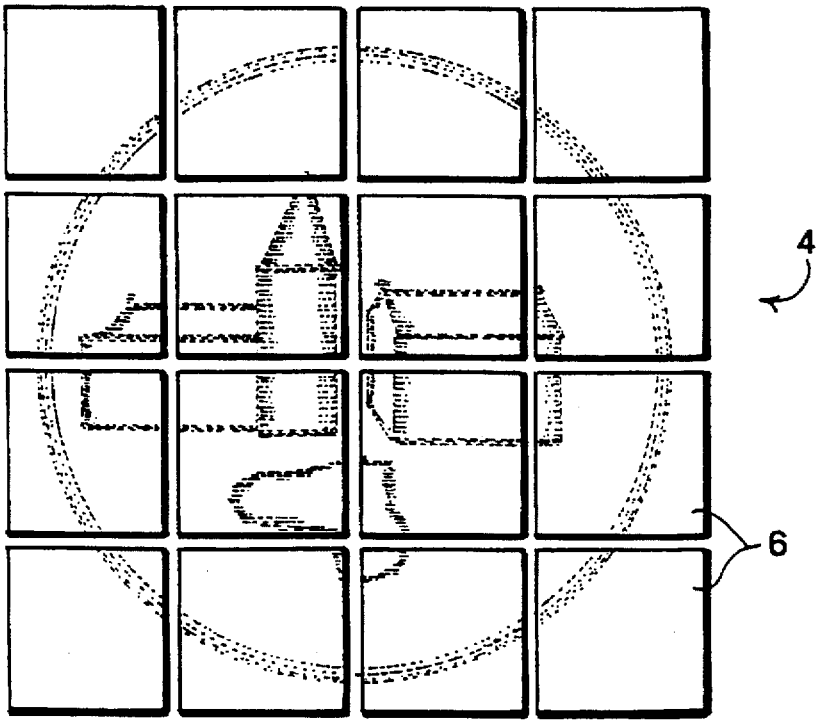
FIGS. 4*a* and 4*b* correspond to FIGS. 3*a* and 3*b*, but relate to the second embodiment.
Figure 4B:
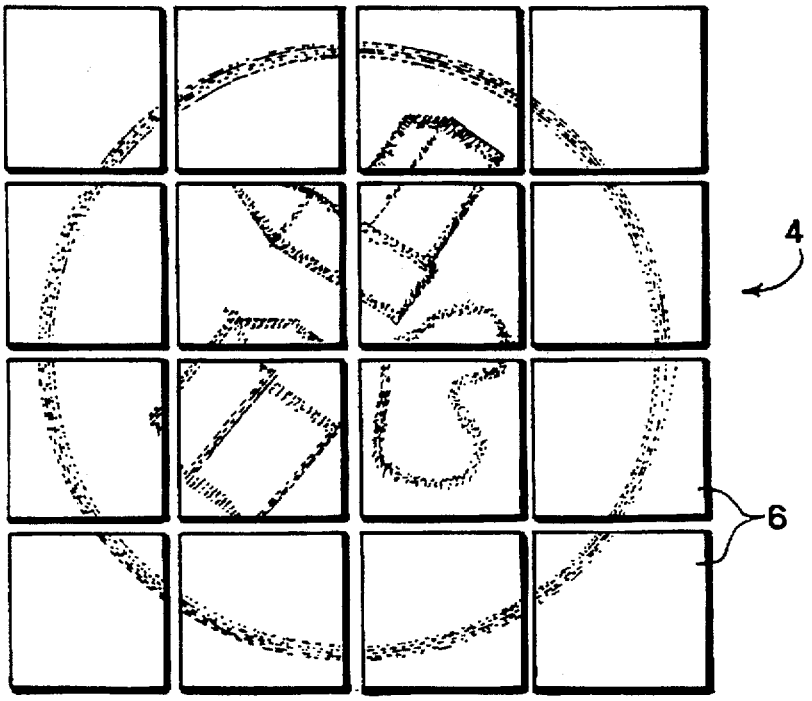

FIGS. 4*a* and 4*b* illustrate a second embodiment making use of a circular picture. FIG. 4*a* shows the circular picture 4 printed upright on a square background which is then divided into square pieces 6. FIG. 4*b* shows the identical circular picture 4 printed at an angle on a square background which is then divided into square pieces 6.

Many variations are possible. A game may be provided for three, four or more players, this involves the provision of a board with a suitable number of recesses, and a suitable number of sets of pieces. Additional pieces may be included which do not fit either of the two (or more) sets, these are introduced to complicate the game. Alternatively, additional pieces may be provided which do fit (i.e. duplicate pieces), and these may simplify the game.

I claim:

1. A game comprising:

a game board having an upper surface defining two recesses;

two sets of rectangular pieces which may be assembled to reconstitute two similar pictures, one picture within and filling each recess, the pieces of the two sets being of the same shape and size but each piece belonging to one set only and not the other by virtue of the pieces bearing non-interchangeable elements of pictures to be reconstituted; and the pieces are rectangular, with one picture being reconstituted from pieces bearing upright rectangular elements of the picture and the other picture being reconstituted from pieces bearing horizontal rectangular elements of the picture.

2. A game according to claim 1 including additional pieces which do not fit either of the two sets.

3. A game according to claim 1 including additional pieces which fit at least one of the two sets.

4. A game according to claim 1 in which the two pictures are identical.

5. A game comprising:

a game board having an upper surface defining two recesses; and two sets of rectangular pieces which may be assembled to reconstitute two similar pictures, one picture within and filling each recess, the pieces of the two sets being of the same shape and size but each piece belonging to one set only and not the other by virtue of the pieces bearing non-interchangeable elements of pictures to be reconstituted, each set having been formed from one of two pictures by cutting the picture at right angles relative to the cutting of the picture of the other set.

6. A game according to claim 5 including additional pieces which do not fit either of the two sets.

7. a game according to claim 5 including additional pieces which do fit one or other set.

8. A game according to claim 5 in which the two pictures are identical.

9. A game comprising:

a game board having an upper surface defining two recesses; and two sets of rectangular pieces which may be assembled to reconstitute two similar pictures, one picture within and filling each recess, the pieces of the two sets being of the same shape and size but each piece belonging to one set only and not the other by virtue of the pieces bearing non-interchangeable elements of pictures to be reconstituted, in which one picture is to be reconstituted from pieces bearing a first picture orientation on said rectangular elements of the picture and the other picture is to be reconstituted from pieces bearing a second picture orientation on said rectangular elements, said second picture orientation being different from said first picture orientation.

10. A game according to claim 9 said one picture is to be reconstituted from pieces bearing upright rectangular elements of the picture and the other picture is to be reconstituted from pieces bearing horizonal rectangular elements of the picture.

11. A game according to claim 9 including additional pieces which do not fit either of the two sets.

12. A game according to claim 9 including additional pieces which fit at least one of the two sets.

13. A game according to claim 9 in which the two pictures are identical.

* * * * *